United States Patent [19]

Mourier

[11] Patent Number: 5,032,763

[45] Date of Patent: Jul. 16, 1991

[54] TRAJECTORY CORRECTING DEVICE FOR ELECTRON TUBES

[75] Inventor: Georges Mourier, Mareil sur Mauldre, France

[73] Assignee: Thomson-CSF, Puteaux, France

[21] Appl. No.: 409,016

[22] Filed: Sep. 18, 1989

[30] Foreign Application Priority Data

Sep. 23, 1988 [FR] France ..... 88 12467

[51] Int. Cl.[5] ..... H01J 23/087

[52] U.S. Cl. ..... 315/5.35; 315/5.14

[58] Field of Search ..... 315/5.14, 5.29, 5.31, 315/5.34, 5.35, 5.51, 5.41, 5.42

[56] References Cited

U.S. PATENT DOCUMENTS

| | | | |
|---|---|---|---|
| 2,811,663 | 10/1957 | Brewer et al. | 315/3.5 |
| 2,925,517 | 2/1960 | Glass | 315/3.5 |
| 2,966,609 | 12/1960 | Turner | 315/3.5 |
| 3,107,313 | 10/1963 | Hechtel | 315/5.16 |
| 3,248,597 | 4/1966 | Boyd et al. | 315/5.51 X |
| 3,700,945 | 10/1972 | Friedman et al. | 315/5.39 X |
| 4,199,709 | 4/1980 | Alirot et al. | 315/5.31 X |
| 4,350,927 | 9/1982 | Maschke | 315/5.35 X |
| 4,433,270 | 2/1984 | Drozdov | 315/5.35 |
| 4,733,131 | 3/1988 | Tran et al. | 315/5.14 |
| 4,893,058 | 1/1990 | Gueguen et al. | 315/5.35 X |

FOREIGN PATENT DOCUMENTS

| | | |
|---|---|---|
| 0000309 | 1/1979 | European Pat. Off. . |
| 1491370 | 4/1969 | Fed. Rep. of Germany . |
| 994988 | 11/1951 | France . |
| 1324415 | 3/1963 | France . |
| 918731 | 2/1963 | United Kingdom . |
| 922532 | 4/1963 | United Kingdom . |

OTHER PUBLICATIONS

A. LeBlond, "Les Tubes Hyperfrequences", vol. 2, 1972.

R. Warnelke et al.: "Les Tubes Electroniques a Commande par Modulation de Vitesse", 1951.

*Primary Examiner*—Eugene R. LaRoche
*Assistant Examiner*—Benny Lee
*Attorney, Agent, or Firm*—Roland Plottel

[57] ABSTRACT

A trajectory correcting device for electron tubes comprises an auxiliary trajectory correcting means capable of creating a magnetic field that corrects the effects of azimuthal drift of the beam between a first disk and a second disk. This drift is due to the non-uniformity of the main field between the two disks. This means may include several coils, through which currents flow, placed in the vicinity of the disks or between them. The device can be applied to multibeam klystrons.

8 Claims, 3 Drawing Sheets

FIG.1
PRIOR ART
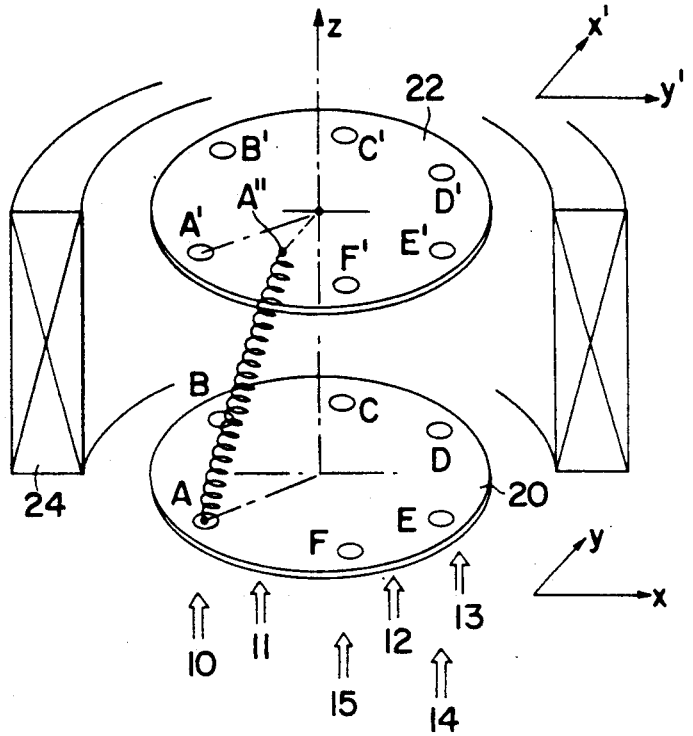
FIG.2
PRIOR ART
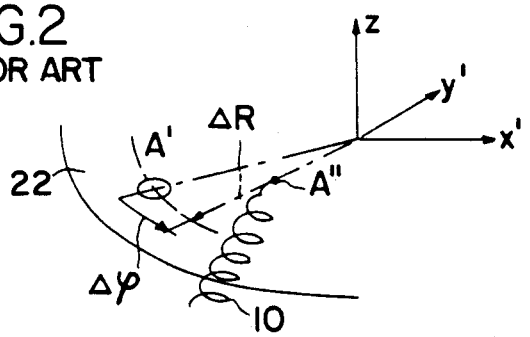
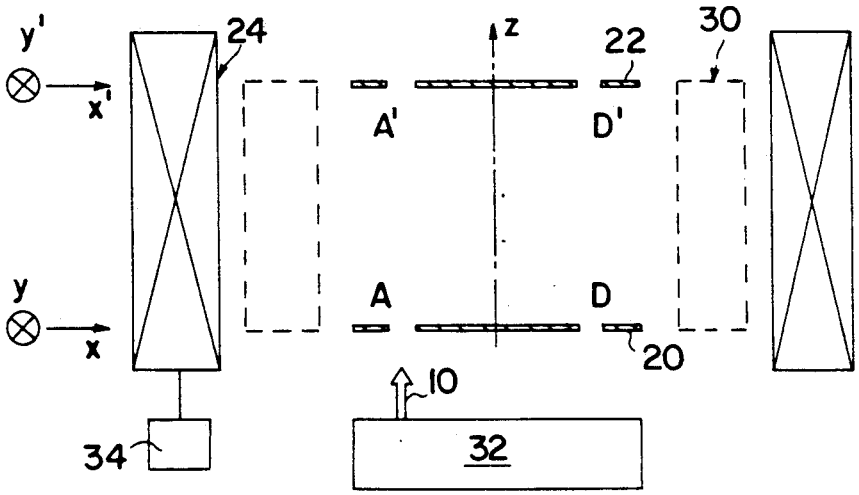
FIG.3

TRAJECTORY CORRECTING DEVICE FOR ELECTRON TUBES

BACKGROUND OF THE INVENTION

1. Field of the Invention

An object of the present invention is a trajectory correction device for electron tubes. It can be applied notably to multibeam tubes and, in particular, to klystron type microwave tubes.

2. Description of the Prior Art

FIG. 1 gives a schematic view of a prior art multibeam electron tube.

The structure has a shape generated by revolution around an axis z. Electron beams, six in this example, namely 10, 11, 12, 13, 14, 15, are produced by a means (not shown) and respectively go through holes A, B, C, D, E, F, pierced in a first disk 20, centered on the axis z and placed in a plane (x, y), and holes A', B', C', D', E', F', pierced in a second disk 22, also centered on the axis z and located in a plane (x', y').

Each pair A and A', B and B', C and C', D and D', E and E', F and F', is centered on a straight line parallel to the axis z.

The electrons are guided by a magnetic field, called a main field, which is generated by a system 24 of coils having the axis z as its axis of symmetry and having DC currents flowing through it. The principal magnetic field also takes the axis z as the axis of revolution.

This main magnetic field is essentially directed along the axis z between the two disks 20 and 22, but the axial component Bz of this field varies as a function of the distance from the axis. In other words, the axial component of the field shows a radial gradient.

This non-uniformity of the magnetic field as well as the off-centered position of the beams causes a drift in the trajectory of the electrons.

More precisely, the mean trajectory of the electrons is not directed in parallel to the axis z. This is illustrated in FIG. 2 which gives a schematic view of the disk of FIG. 1, showing the radial and azimuthal drift of an electron beam. Each beam undergoes a radial drift $\Delta R$ and an azimuthal drift $\Delta\rho$.

As can be seen in FIG. 2, the electron beam 10 tends to strike the disk 22 at A'' instead of passing through A'. There is a similar situation for the other beams.

It is known that the radial drift $\Delta R$ can be cancelled. It is enough for the fluxes of the field through circles going through the holes A and A' (B and B', C and C', D and D', E and E', F and F' respectively) to be identical.

For the proper functioning of the tube, two conditions are then imposed on the main magnetic field: its amplitude should be substantially the same at the level of the homologous holes A and A', B and B', . . . , and the fluxes through the circles passing by these space should be identical.

However, these tubes designed in this way also have a drawback which is that they have an azimuthal drift, with an amplitude of $\Delta\rho$.

An aim of the present invention is to overcome this drawback by providing the means to remove this azimuthal drift.

To this end, the invention proposes the use of coils and/or additional ferromagnetic parts, capable of creating a magnetic correction field, which gets added to the main magnetic field and brings the electrons back to the space A'.

SUMMARY OF THE INVENTION

More precisely, the present invention concerns a trajectory correction device for electron tubes, this tube comprising a principal means capable of generating a main magnetic field of revolution around an axis and means to create at least one electron beam separated from this axis and passing successively through a first hole pierced in a first disk, then through a second hole pierced in a second disk, said device comprising at least at least one thin auxiliary means centered on the axis of revolution and capable of creating an auxiliary corrective magnetic field having a same axis of revolution as the main field and having a radial gradient said auxiliary field correcting the effects of azimuthal drift of the beam between the first hole and the second hole, said drift being due to the non-uniformity of the main magnetic field between the two holes.

In a first embodiment, the auxiliary means of correction consists of a first coil and a second coil, through which currents flow, placed in the vicinity of the planes of the first hole and the second hole.

In another embodiment, the auxiliary correction means consists of a coil, through which a current flows, placed in the median plane with respect to the planes o the first and second holes.

In an alternative embodiment, the auxiliary means consist of a first coil placed in the vicinity of the plane of the first hole, a second coil placed in the vicinity of the plane of the second hole and a third coil placed in the median plane, and currents flow through these coils.

In another embodiment, the auxiliary means of correction consists of a ferromagnetic part placed in the median plane with respect to the planes of the first and second holes, the axis of revolution being the axis of symmetry of this part. This part may be a disk, a cylinder or a torus.

BRIEF DESCRIPTION OF THE DRAWINGS

The characteristics and features of the invention will appear more clearly in light of the following description of examples that are given by way of explanation and in no way restrict the scope of the invention. This description is made with reference to the appended drawings, wherein:

FIG. 1, already described, schematically represents a multibeam electron tube according to the prior art;

FIG. 2, already described, is a schematic view of a disk showing the radial and azimuthal drift of an electron beam according to the prior art;

FIG. 3 schematically represents a sectional view of a multibeam tube provided by a device according to the invention;

DESCRIPTION OF PREFERRED EMBODIMENTS

Figure 4:
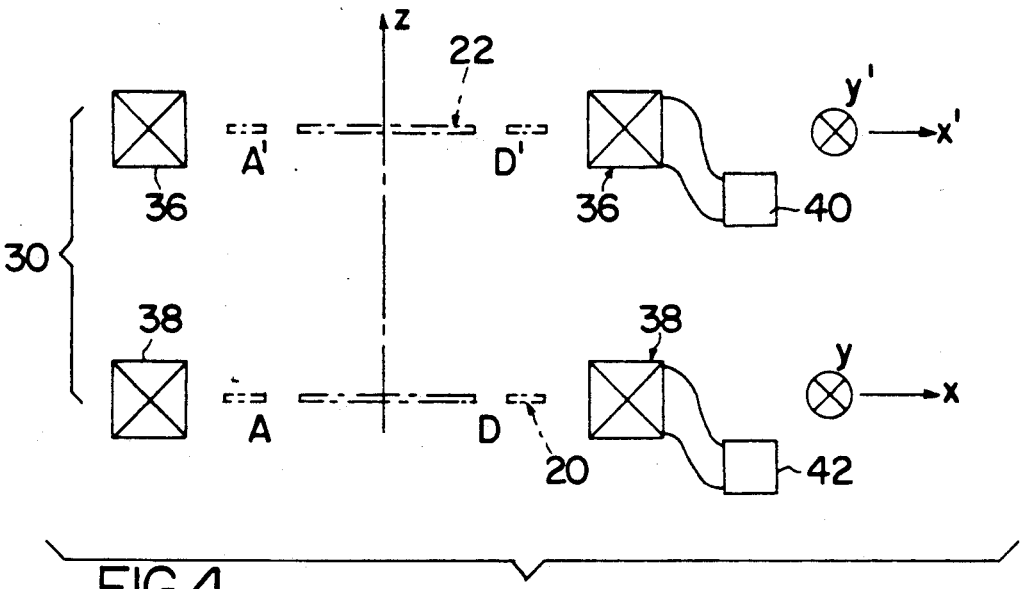
FIG. 4 schematically represents a sectional view of an embodiment of a device according to the invention.

FIG. 3 schematically represents the section of a multibeam tube provided with a correction device according to the invention.

An electron beam 10 has emerged from a means 32 (cathode or other) and has its mean trajectory parallel to the axis z, the axis of symmetry of the system. This trajectory is separated from the axis z.

The beam goes through a first hole A pierced in a first disk 20 located in a plane (x, y) and has to go through a second hole A' pierced in a second disk 22 located in a plane (x', y'). For this purpose, it is guided by a main magnetic field which meets the following conditions:

at A and A', the amplitude of the field is the same;

the fluxes of the field (not shown) through the surfaces of the circles centered on z and going through A and A' are identical.

Thus, the radial drift of the electron beam is cancelled.

The azimuthal drift is compensated for, according to the invention, by an auxiliary means of trajectory correction 30 capable of creating a magnetic field correcting the effects of azimuthal drift of the trajectory between the first space and the second space A, A'.

Means 34 are provided to adjust the current that flows through the coils of the main system 24 to preserve the value of the flux of the total magnetic field despite the auxiliary magnetic field due to the means 30.

The trajectory of the electrons is not, in fact, rectilinear between A and A'. It is helically wound around the magnetic field. Two cases may occur depending on the values of the energy brought into play. In the first case, it is assumed that the electrons make a large number of orbits between the two disks. In the second case, it is assumed, that they make few orbits.

In the former case, the inventor has shown that the azimuthal drift of the electrons is due to a force passing through the axis z. This force gives the electrons a tangential speed that is proportionate to the gradient of the axial component B (not shown) of the field along the radius (not shown). In other words, the azimuthal speed is proportionate to $\partial B_z/\partial r$.

The total azimuthal drift $\Delta\rho$ (not shown) is therefore proportionate to the integral of this magnitude between the spaces A and A'.

More precisely, we have:

$$\Delta\rho \simeq \frac{m}{2q} \int_A^{A'} \frac{V_b^2}{V_z B^2} \frac{\partial B_z}{\partial r} dz = 0$$

where q and m being the charge and the mass of the electron respectively, $V_b$ being the speed of rotation of an electron around the magnetic field, $V_z$ being the speed at which an electron is shifted along the direction of the axis z; and B being the amplitude of the magnetic field applied, and $B_z$ is its component in the direction z, and r is the distance from the axis.

In the latter case, the electrons of a beam travel through only few orbits between A and A'. The inventor has shown, then, that the azimuthal drift $\Delta\rho$ between A and A' takes the form:

$$\Delta\rho \simeq -\frac{q}{2\pi} \int_A^{A'} \frac{\phi - \phi_o}{r^2} \frac{dz}{mV_z}$$

where $\phi$ is the value of the flux of the magnetic field going through the circle with a radius r, centered on the axis of symmetry z and going through the position of the electron;

$\phi$ is the value of 0 at an original point of the drift $\Delta\rho$, and q and m are the charge and the mass of the electron respectively.

The terms m and $V_z$ are substantially constant in practice. $\phi$-$\phi_o$ may be positive or negative, depending on the nature of the magnetic fields applied.

The integral of $\phi$-$\phi_o$ on a path going from A to A' should be made null.

In particular, if we take the so-called "thin lenses" approximation, it is shown that:

$$\Delta\rho \simeq -\frac{q}{2\pi m r^2 Vz} \int_A^{A'} (\phi - \phi_o)\, dz$$

The cancellation of the azimuthal drift ($\Delta\rho=0$) implies that the mean value of the flux $\phi$ is equal to even if, locally, its value is different from $\phi_o$.

It is thus seen that the compensation for the azimuthal drift ends, in the former case, in conditions at the ends on the trajectories and, in the second case, in mean conditions on the trajectories. Besides, these conditions are compatible.

In other words, according to the invention, an auxiliary field with high radial gradient is created so that the drift induced by this auxiliary gradient compensates for the drift caused by the non-uniformity of the main field.

The function of the trajectory correction auxiliary means 30 is to meet these conditions. This means is thin or flat for it is under these conditions that a field with a low amplitude but a high gradient is obtained.

FIG. 4 schematically represents a sectional view of a first embodiment of a device according to the invention. The auxiliary means 30 consist of two flat coils 36 and 38, each supplied with current by a respective generator 40, 42. The coil 38 is located in the vicinity of the plane (x, y) containing the first disk 20 through which the electron beam goes. The coil 36 is located in the vicinity of the plane x', y' containing the second disk 22. These coils 36, 38 are respectively parallel to these planes (x, y) and (x', y') and centered on the axis z.

The gradient of the axial field induced by a coil is positive in its plane, inside the coil. By contrast, this gradient is negative in the median plane of a system with two coils at a sufficient distance from each other. It is therefore possible to cancel the effect of the component $\partial B_z/\partial r$ along a path from A towards A' by adjusting the dimensions and spacing of the two coils 36 and 38.

The coils 36, 38 thus induce magnetic fields of compensation at the ends of the zone located between the disks 20 and 22. They make it possible, then, to compensate for the azimuthal drift if the electrons of the beams should describe a large number of orbits on their trajectory.

Those skilled in the art are able, by digital computation, to establish the relationship between the dimensions of the coils and the fields, and to adapt the device to each particular case. The Hz variation around the axis changes sign when the distance between the coils is equal to their radius (Helmholz approximation). The exact calculation in each case is done by computer.

Figure 5:
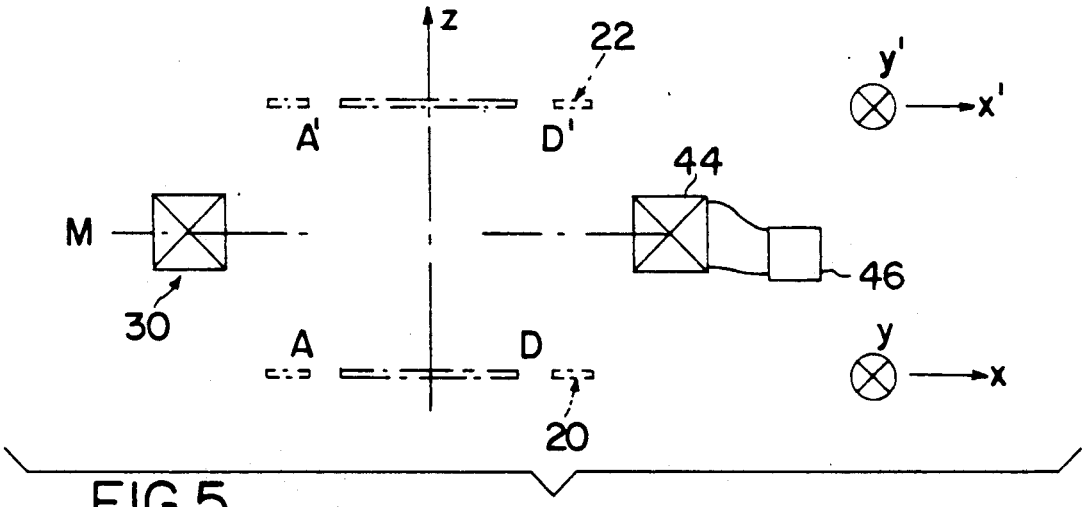
FIG. 5 schematically represents a sectional view of another embodiment of a device according to the invention.

FIG. 5 schematically represents a sectional view of another embodiment of a device according to the invention. The means 30 consists of a flat coil 44 through which there flows a current generated by a generator 46. This coil 44 is placed in the median plane M parallel with respect to the planes (x, y) and (x', y'). The distance between two diametrically opposite spaces (such as A and D in FIG. 5) should be smaller than the diameter of the coil 44. But the diameter of this coil is such that it is very close to the trajectory of the electrons. The coil 44 may have a diameter which is greater, by 10%, than the distance between A and D, for example.

This coil 44 induces a magnetic compensation field at the median plane M. It enables the compensation of the azimuthal drift if the electrons should describe few orbits all along their trajectory.

Figure 6:
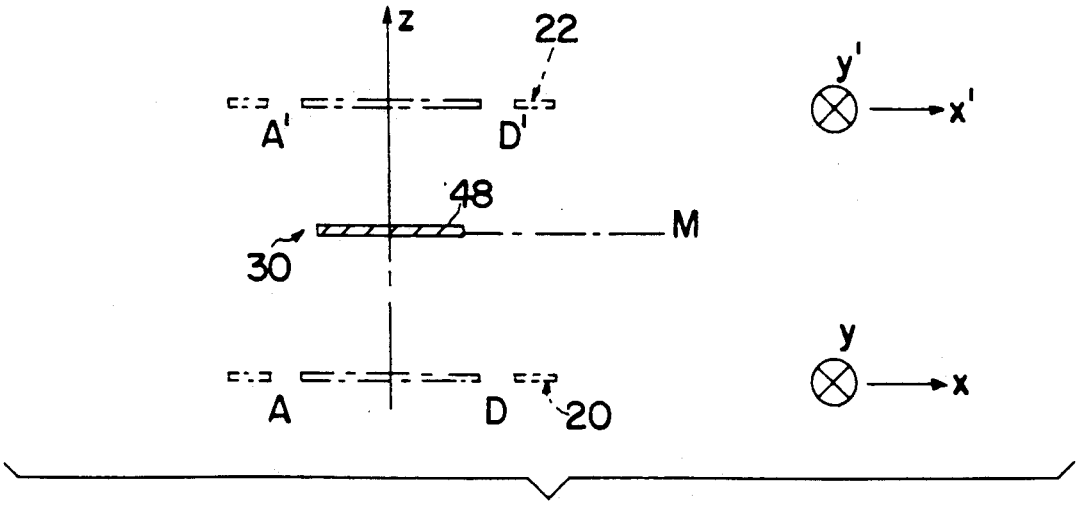
FIG. 6 schematically represents a sectional view of an alternative embodiment of a device according to the invention.

According to the variant illustrated in FIG. 6, a similar result may be obtained by a ferromagnetic part 48, placed in the median plane M with respect to the planes (x, y) and (x' y'), the axis z being an axis of symmetry for this part.

This part may be a disk, a cylinder or a torus for example. The diameter of this part is smaller than the distance between two diametrically opposite spaces (A, D in FIG. 6).

Of course, the different devices described above can be combined to obtain a more efficient compensation for the azimuthal drift.

Figure 7:
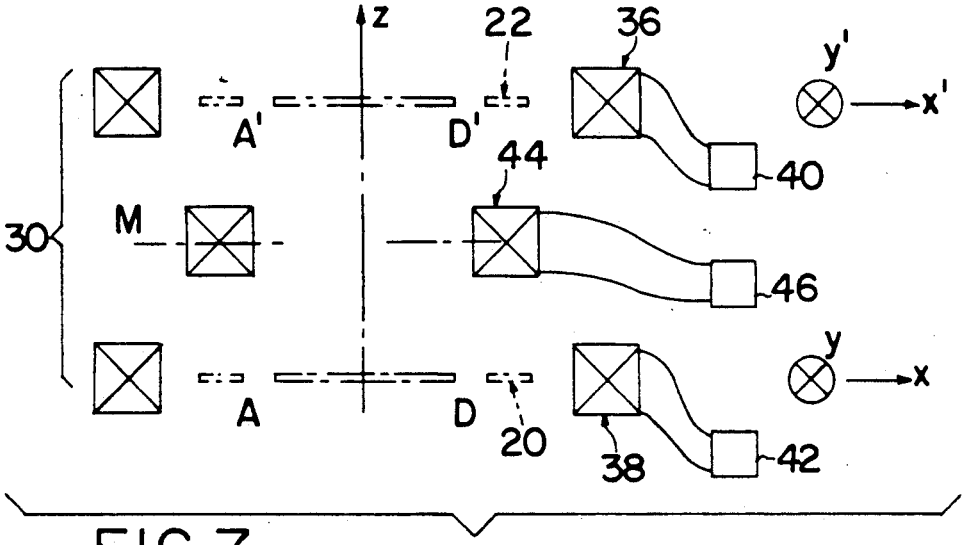
FIG. 7 schematically represents a sectional view of another embodiment of a device according to the invention.

Thus, FIG. 7 shows a device that combines the devices of FIGS. 4 and 5. This device can be applied to all cases, irrespectively of whether the electrons describe few or many orbits on their trajectory. It can be applied particularly well to intermediate cases.

In the configuration of FIG. 7, the auxiliary means of correction 30 thus consists of two coils 36, 38 respectively connected to current generators 40, 42 and of a coil 44 with a smaller diameter, connected to a current generator 46. The two coils 36, 38 are each placed in one of the planes (x, y) and (x', y'), the coil 44 being located in the median plane M with respect to these planes.

Figure 8:
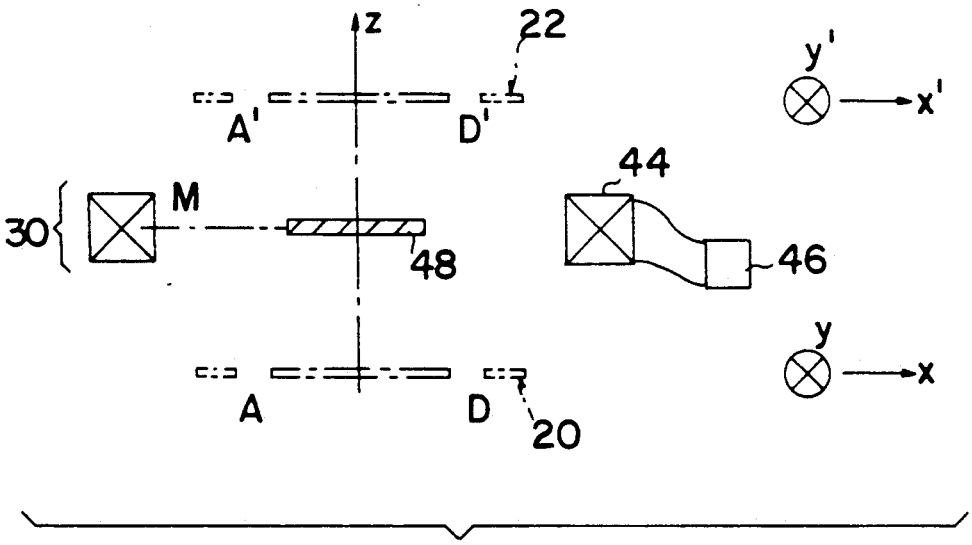
FIG. 8 schematically represents a sectional view of another alternative embodiment of a device according to the invention.

Naturally, and this point is already entailed in the above description, it goes without saying that the invention is not restricted solely to the above-described embodiments. On the contrary, it encompasses all variants. As shown in FIG. 8, it is possible, for example, to combine the devices described in FIGS. 5 and 6 or, alternatively the devices shown in FIGS. 4 and 6 (not shown in FIG. 8).

What is claimed is:

1. A trajectory correction device for electron tubes, said tube comprising means for generating a main magnetic field of revolution around an axis and means for creating at least one electron beam separated from and close to said axis and said electron beam passing successively through a first hole in a first disk and then through a second hole in a second disk, said disks being disposed in parallel lanes, said device comprising at least one auxiliary means centered on the axis of revolution for creating an auxiliary corrective magnetic field having a same axis of revolution as the axis of the main field, and having a radial gradient, said auxiliary field correcting the effects of azimuthal drift of the beam between the first hole and the second hole of the first and second disks respectively, said drift being due to the non-uniformity of the main magnetic field between the two holes.

2. A device according to claim 1, characterized in that the auxiliary means of correction comprise a first coil and a second coil, said coils being located respectively adjacent to the first disk and the second disk.

3. A device according to claim 2, wherein the auxiliary correction means further comprises a third coil placed in a parallel plane median between said first and second coils.

4. A device according to claim 1 wherein said first and second disks are disposed in separate parallel lanes, and the auxiliary correction means comprises a first coil placed adjacent the plane of the first disk, a second coil placed adjacent the plane of the second disk, and a third coil placed in a plane median to and parallel with respect to the planes of the first and second disks.

5. A device according to claim 1, wherein the auxiliary correction means comprises a ferromagnetic part placed in a parallel plane median with respect to the planes of the first and second disks, said part having an axis of symmetry co-axial with the axis of revolution.

6. A device according to claim 1, wherein said first and second disks are disposed in separate parallel planes, and the auxiliary correction means comprises a single coil, placed in a plane median to and parallel with respect to the planes of the first and second disks.

7. A device according to claim 6, wherein the auxiliary correction means further comprising two coils, one of said two coils being placed adjacent the plane of the first disk, and the other of said two coils being placed adjacent the plane of the second disk.

8. A trajectory correction device for electron tubes, said tube comprising means for generating a main magnetic field of revolution around an axis; and means for creating electron beams substantially in the direction of said axis and spaced from said axis, and said electron beams passing successively through first holes in a first disk and then through second holes in a second disk, said disks being disposed in parallel planes; said device comprising at least one auxiliary means centered on the axis of revolution for creating an auxiliary corrective magnetic field having a same axis of revolution as the axis of the main field, and having a radial gradient, said auxiliary field correcting the effects of azimuthal drift of the beams between the first holes of the first disk and second holes of the second disk, respectively, said drift being due to the non-uniformity of the main magnetic field between the first and second holes of the first and second disks.

* * * * *